US005927509A

United States Patent [19]

Lord

[11] Patent Number: 5,927,509

[45] Date of Patent: Jul. 27, 1999

[54] GOLD SEPARATION KIT

[76] Inventor: Jerome Lord, 55570 NW. Schmidt Hill Rd., Gales Creek, Oreg. 97117

[21] Appl. No.: 08/934,469

[22] Filed: Sep. 19, 1997

[51] Int. Cl.[6] ..... B03B 7/00

[52] U.S. Cl. ..... 209/44; 209/446; 209/488

[58] Field of Search ..... 209/44, 435, 437, 209/445, 446, 447, 458, 488, 490

[56] References Cited

U.S. PATENT DOCUMENTS

| | | | |
|---|---|---|---|
| 4,319,994 | 3/1982 | Morgan | 209/447 |
| 4,359,383 | 11/1982 | Sweet | 209/44 X |
| 4,525,270 | 6/1985 | McCann | 209/44 |

*Primary Examiner*—Tuan N. Nguyen
*Attorney, Agent, or Firm*—William S. Lovell

[57] ABSTRACT

A self-contained gold separation kit adapted for easy carrying using a shoulder strap uses a single-spring rocker assembly for agitation of stream bed materials for separation of gold. The main kit elements include a sluice box, material tower and collector tray that are contained for carrying within a box, and in use those elements are then rotatably mounted above the carrying box. That box also serves to contain a quantity of water to be used repeatedly in washing out the bed materials, hence the device can be used at a distance away from stream bed. The weight of that water also serves to prevent the device as a whole both from moving about while being rocked and from tipping over. A dipper is included for dipping water over the bed materials, and also a gold pan for the final separation of the gold and a collector tray for collecting tailings from the gold separation. The device is also adapted for use at the edge of a stream whereby water is taken from the stream and the tailings may be allowed to fall into the stream.

8 Claims, 6 Drawing Sheets

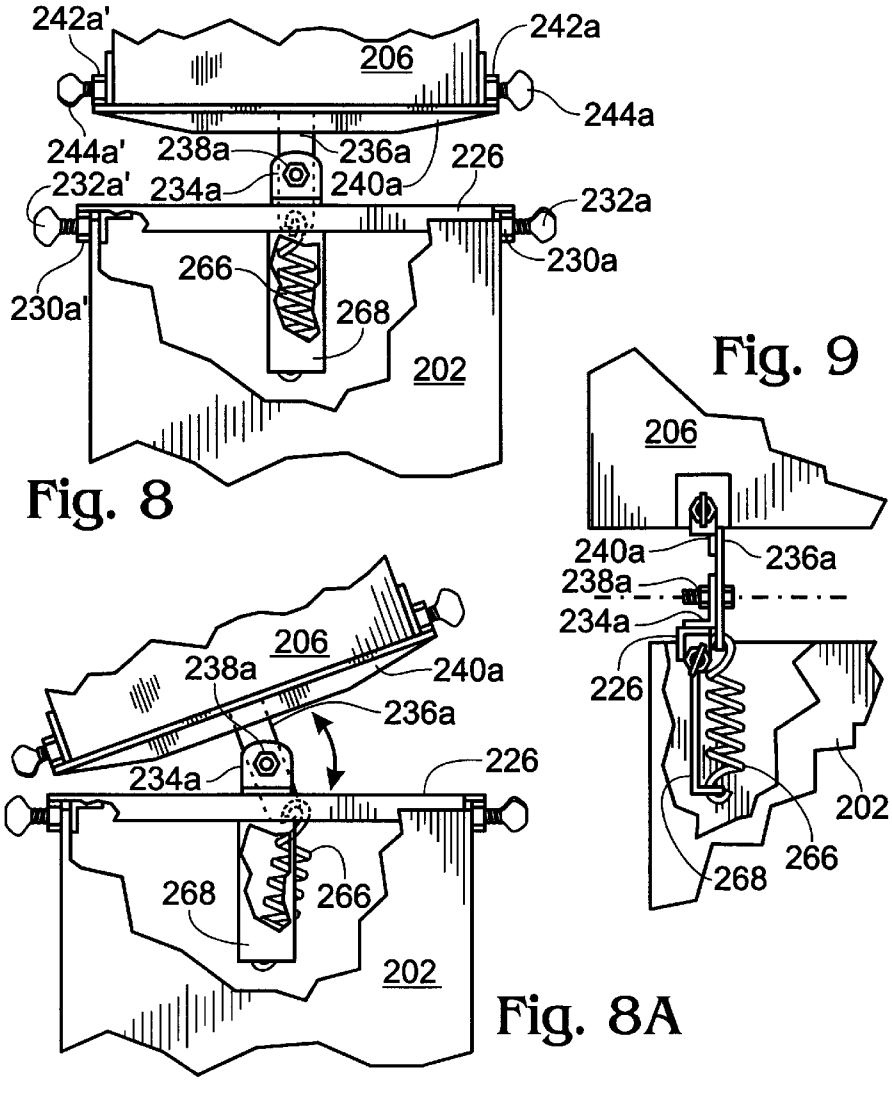
Fig. 9
Fig. 8
Fig. 8A
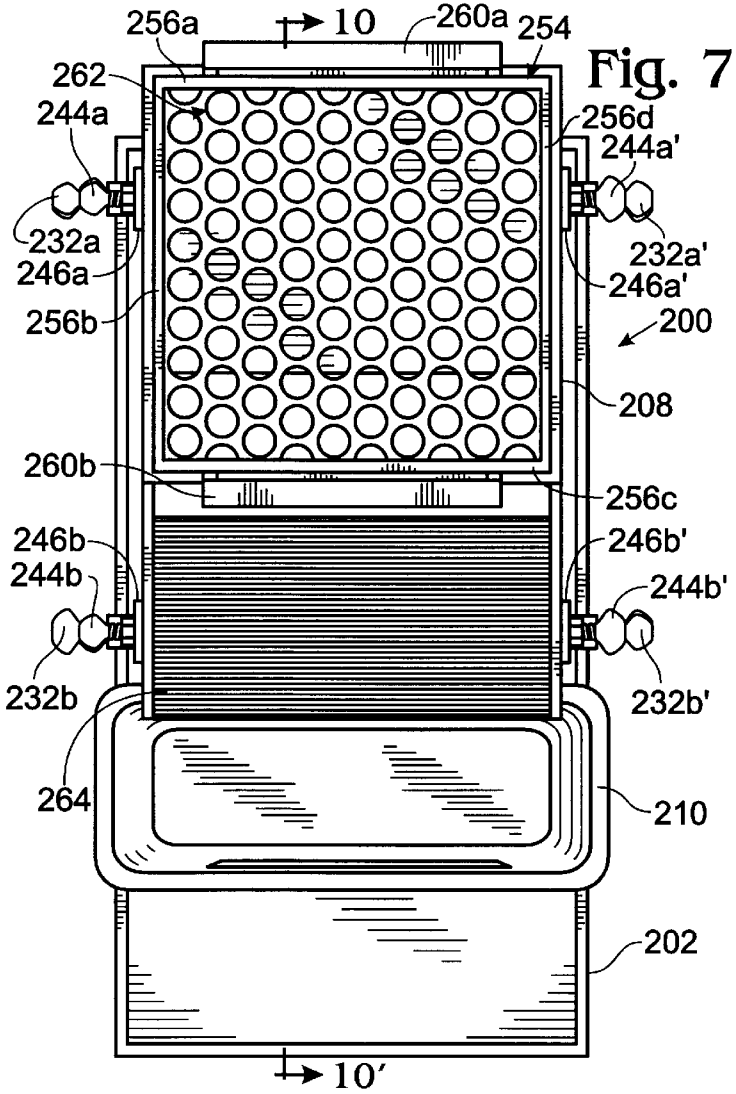
Fig. 7

GOLD SEPARATION KIT

BACKGROUND OF THE INVENTION

FIELD OF THE INVENTION

This invention relates to methods and apparatus for collecting and concentrating gold, typically in the form of small dust particles, that may be found in the mud and sand of stream beds. The invention relates especially to such methods and apparatus that permit the concentration process to be carried out either immediately by a stream or removed therefrom, as up on a bank or even isolated from any stream.

BACKGROUND INFORMATION

Panning or otherwise trying to extract and concentrate gold from stream beds in the Western United States has a very long history for which a wide variety of implements have been employed, ranging from rather large sluice boxes in the more expansive operations to simple gold pans in which bottom soil or sand, hereinafter called "bed material," would be agitated in order to cause the heavier gold to settle out for extraction. A recent device in the prior art, sold by Gold King Placer Equip. Mfg. of Buckeye, Ariz. under the name "Gold King Rocker Box," is shown as gold collector 100 in FIGS. 1–3.

Specifically, gold collector 100 comprises in principal part an open, elongate rectangular bottom frame 102 above which, and along the long axis thereof, is disposed a similarly elongate rectangular sluice box 104. Sluice box 104 is disposed at a slant along its long axis relative to bottom frame 102, thus to define a first or upper end 106 thereof (to the left in FIG. 1) and a second or lower end 108 (to the right in FIG. 1). Sluice box 104 itself comprises an elongate, rectangular base plate 110 and attached on opposite long sides thereof a pair of mutually parallel and mutually facing side walls 112*a*, 112*b*. Sluice box 104 is disposed above bottom frame 102 by means of a rocker assembly 114 at upper end 106 thereof and by an interconnecting, inverted V-plate 116 at lower end 108 thereof.

Gold collector 100 further comprises a bin frame 118 that is disposed within upper end 106 of sluice box 104 and which consists essentially of a superstructure thereto, i.e., mutually parallel and facing upper walls 120*a*, 120*b* are disposed respectively against side walls 112*a*, 112*b* at upper end 106 of sluice box 104, and then upper and lower strut plates 122*a*, 122*b* (of which only lower strut plate 122*b* is shown in FIG. 1) extend transversely between opposite ends, respectively, of upper walls 120*a*, 120*b* so as to define an open, rectangular opening therewithin.

Bin frame 118 is thus adapted to receive therewithin a classifier 124, which is generally elongate and has mutually parallel and facing bin walls 126*a*, 126*b* that define the long dimension thereof, and corresponding end walls 128*a*, 128*b* attach respectively at opposite ends of bin walls 126*a*, 126*b*, so as to define a rectangular shape to the upper portion of bin 124.

However, the vertical descent of end walls 128*a*, 128*b* is much less than that of bin walls 126*a*, 126*b*, and moreover end walls 128*a*, 128*b* also turn one towards the other at the terminus of the aforesaid vertical descent, thus to define corresponding bottom plates 130*a*, 130*b* as shown in FIG. 1 that descend at complementary angles so as to define an upright "V," but one that is truncated well before the end point of such a "V." Bin walls 126*a*, 126*b* have a corresponding truncated "V" structure, and the bottom ends of bin walls 126*a*, 126*b* and of bottom plates 130*a*, 130*b* are all essentially co-planar and define a nearly square aperture at the bottom of bin 124.

FIG. 2 is a longitudinal cross-sectional view of gold collector 100 taken along the line 2–2' of FIG. 1. Additional elements thereof that can better be seen in FIG. 2 include a floor mat 132 that covers the top of base plate 110; a wing nut/bolt structure 134 that holds a bracket 136 onto the underside of base plate 110 at the lower end 108 of sluice box 104; and a first bolt assembly 138 that rotatably attaches bracket 136 (and hence lower end 108 of sluice box 104) to V-plate 116.

At upper end 106 of sluice box 104, it can be seen in both of FIGS. 1, 2 that rocker assembly 114 further comprises vertical post 140 that is attached at the bottom thereof to bottom frame 102 near the transverse center point thereof, and T-bar 142 that is rotatably attached to the top of vertical post 140 by second bolt assembly 144. First bolt assembly 138 and second bolt assembly 144 are coaxial along axis 146. Base plate 110 attaches atop T-bar 142 at upper end 106 of sluice box 104.

Also included in rocker assembly 114 are springs 148*a*, 148*b* seen in FIG. 3, that respectively extend from near to the opposite comers of bottom frame 102 near upper end 106 of sluice box 104 to corresponding opposite ends of T-bar 142. A rocking lever 150 is attached to upper strut plate 112*a* in a central vertical plane that passes through axis 146. Upper strut plate 122*a*, unlike lower strut plate 122*b*, extends fully downward to encounter base plate 110 and thereby effectively closes off upper end 106 of sluice box 104. (Lower end 108 of sluice box 104 is open.) As seen in FIG. 3, manual transverse rotation of rocking lever 150 as shown by arrows 152 causes rotation of entire sluice box 104 about axis 146.

Turning back now to FIG. 2, it can be seen that bin frame 118 further comprises a trough 154 consisting of the lower strut plate 122*b* that extends downwardly from near to the end of bin frame 118 that is opposite upper end 106 of sluice box 104, and then a ramp 156 that extends slantwise therefrom back in the direction of upper end 106 of sluice box 104. Also seen in FIG. 2 is a mesh 158 that extends across the bottom aperture of bin 124 in a plane parallel to the slanted plane of bottom plate 110. The slant of ramp 156, however, is opposite that of mesh 158 and bottom plate 110, whereby as a result of rocking of sluice box 104 by means of an alternating rotation (i.e., "rocking") of rocking lever 150, material that is placed within bin 124 and washed with water will be caused to pass through mesh 158 to follow path 160, i.e., first onto ramp 156, downward therefrom to the lower end thereof, then off that end down onto mat 132 that covers bottom plate 110, and then towards lower end 108 of sluice box 104. Mat 132, also commonly called "miners moss," is of a consistency to capture small particles of the heavier gold that is entrapped therein while the lighter soil and sand of a material sample will be washed out from open lower end 108 of sluice box 104. Upon removal of such extraneous material, mat 132 is removed from gold collector 100 by first removing wing nut/bolt structure 134, and the entrapped content of mat 132 is then washed into a pan for panning out any residual gold.

The operation of gold collector 100 does present certain problems, however. In the first place, the rather high center of gravity of the device, particularly when bin 124 is filled with material, makes it relatively easy to tip the entire device over onto its side. Secondly, because of the light weight of the device, the rocking motion imparted to it by sideways movement of rocking lever 150 tends to make the device "walk" or move about along the beach or other surface on which it is being used. Thirdly, the use of two springs 148*a*, 148*b*, which cannot be truly identical as a practical matter and in time will come to have rather different spring constants, will ultimately cause the upper structure of gold collector 100 to lapse into an "at-rest" configuration that is not transversely level. This result will make operation of the device more awkward, and can result in spillage of material. Use of gold collector 100 is also restricted to locations reasonably near to a stream in order for there to be a convenient supply of water for washing out the bed material. (Operation of a gold collector at some distance away from the stream from which material is taken, which is difficult to do with gold collector 100, is called "high banking.") Finally, although bin 124 will ordinarily be of a size that it can conveniently be stored within sluice box 104 when not in use, nevertheless gold collector 100 as a whole can be awkward in size, and difficult to transport to and from a desired stream bed.

SUMMARY OF THE INVENTION

The invention comprises a gold separating kit adapted for easy transportation and use either at a stream bed, on a nearby bank, or elsewhere. The operational elements of the kit are stored in a box having a carrying strap for easy transport. Upon being put into use, those operational elements are mounted atop the carrying box that now serves to hold water, thus providing sufficient weight and a lower center of gravity of the device as a whole so it will not easily be tipped over, and furthermore will not "walk" about on the surface on which it is placed. Secondly, using a dipper also provided, the same water can be dipped repeatedly down onto a classifier that holds the material from which the gold is to be separated. The operation can thus be carried out at any convenient, relatively flat location near to a stream, or indeed quite far removed from any stream, without needing to be placed on a perilous gravel or rocky surface right adjacent the stream. Finally, the required rocking action that serves to separate the gold from the bed material is provided by a single, central spring, hence the separation box will not become transversely unbalanced over time.

BRIEF DESCRIPTION OF THE DRAWINGS

The preferred embodiments of the invention will now be described in detail with reference to the accompanying drawings, in which:

FIG. 7 is a top plan view of the gold separation kit of FIG. 4.

FIGS. 8–8A are enlarged, partially cutaway end views of the rocking portion of the gold separation kit taken from the "8" region of in FIG. 5.

FIG. 9 is an enlarged, partially cutaway side view of the rocking portion of the gold separation kit taken from the "9" region in FIG. 6.

DETAILED DESCRIPTION OF THE INVENTION

Figure 4:
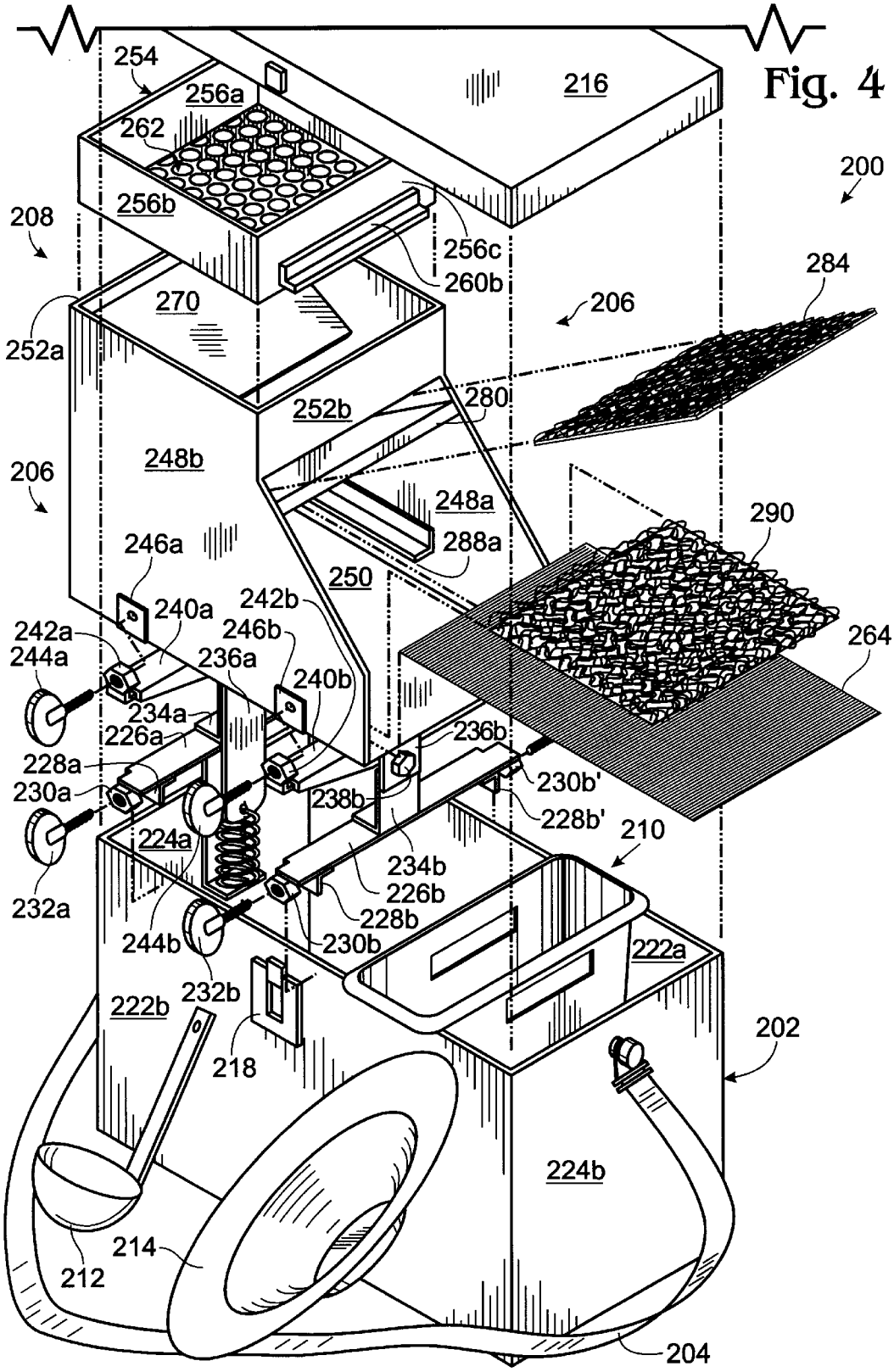
FIG. 4 is an exploded, isometric view of a gold separation kit comprising the invention.

FIG. 4 is an exploded, isometric view of gold separation kit 200 that comprises the invention. Gold separation kit 200 includes box 202, which preferably is of a size to hold about 5 gallons of water and has attached thereto a carrying strap 204, and also sluice box 206. Gold separation kit 200 further comprises a material tower 208, a collector tray 210, a water dipper 212, and a gold pan 214, the uses of which will be described hereinafter, but are all of a size to fit comfortably within box 202 and to be held therein by lid 216. Through the use of carrying strap 204, all of the components of gold separation kit 200 can easily be transported to and from a remote stream bed or other location at which one may wish to extract from the materials there located any included gold.

In practice, lid 216 is removed from box 202 by releasing buckles 218 or any similar, convenient means of connection such as snaps or the like, and then the rest of the aforesaid elements are removed therefrom. Box 202 can then be partially filled with about 5 gallons of water from the stream to be investigated for gold or from another source and then, being carried by means of strap 204, placed at a convenient location, e.g., immediately adjacent a stream, on some nearby bank. (i.e., "highbanking"), or elsewhere. An advantage of highbanking is that there is a minimum of disturbance of the stream itself: water may be removed therefrom, and also bottom materials to be examined for gold, but unlike operations that are effectively "tied" to the side of the stream itself, muddy water or sample materials need not be placed back into the stream to cause it to be stirred up and muddied.

Box 202 is defined by a rectangular bottom plate 220 (best seen in FIG. 10); side walls 222*a*, 222*b* that extend upwardly from bottom plate 220 along the longer dimension thereof; and end walls 224*a*, 224*b* that likewise extend upwardly from bottom plate 220 but along the shorter dimension thereof, those end walls 224*a*, 224*b* then also interconnecting side walls 222*a*, 222*b* at mutually facing ends thereof.

Gold separation kit 200 further comprises a pair of lower struts 226*a*, 226*b* that serve to mount sluice box 206 above box 202. Each of lower struts 226*a*, 226*b* is an elongate flat and narrow plate characterized by respectively having downwardly extending lips 228*a*, 228*a*' and 228*b*, 228*b*' (of which all but lip 228*a*' are shown in FIG. 4) disposed near to respective opposite ends thereof. The distance between lips 228*a*, 228*a*' and likewise between lips 228*b*, 228*b*' is predetermined such that the outer or distal sides of each of lips 228*a*, 228*a*' and likewise of lips 228*b*, 228*b*' coincide with the inner surfaces of side walls 220*a*, 220*b*.

Disposed outwardly from 228*a*, 228*a*' and 228*b*, 228*b*' are corresponding lower nuts 230*a*, 230*a*' and 230*b*, 230*b*' at opposite ends of respective lower struts 226*a*, 226*b*, the distance between the inwardly facing sides of mutually facing lower nuts 230*a*, 230*a*', and similarly as to mutually facing lower nuts 230*b*, 230*b*', being pre-determined so as to correspond nearly to the outer surfaces of side walls 222*a*, 222*b*. Therefore, lower struts 226*a*, 226*b* can be placed atop side walls 226*a*, 226*b* so that the upper edges thereof contact the under surface of lower struts 226*a*, 226*b* at points that are between each of lip 228*a* and lower nut 230*a*; lip 228*a*' and lower nut 230*a*'; lip 228*b* and lower nut 230*b*; and lip 228*b*' and lower nut 230*b*'. In each of the four positions just described, turn bolts 232*a*, 232*a*', 232*b* and 232*b*' are provided that can be hand turned into corresponding lower nuts 230*a*, 230*a*', 230*b* and 230*b*', thereby to removably attach lower struts 226*a*, 226*b* onto the upper edges of side walls 222*a*, 222*b* of box 202.

Figure 1:
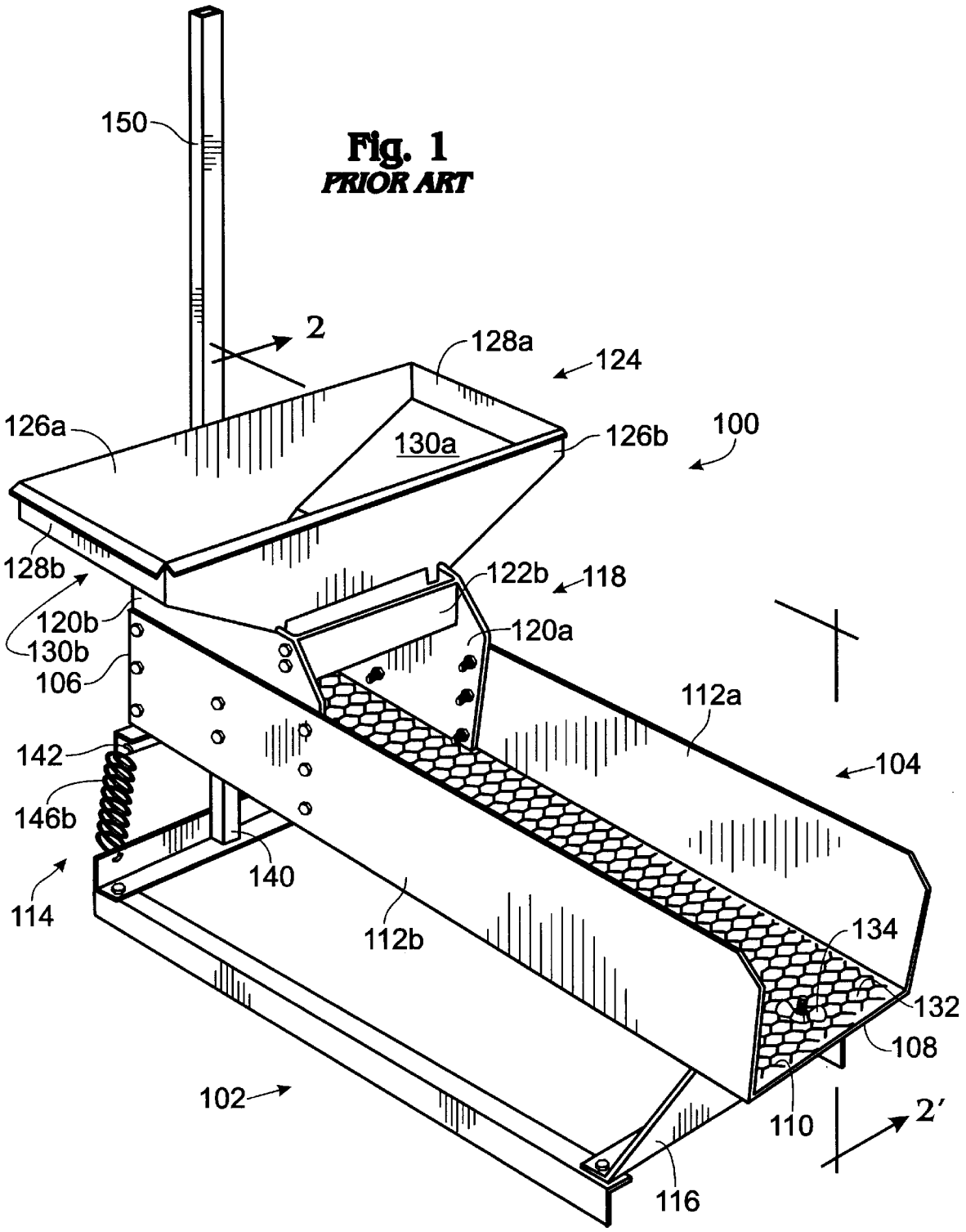
Fig. 1 PRIOR ART
FIG. 1 is a perspective view of a gold collector from the prior art.
Figure 2:
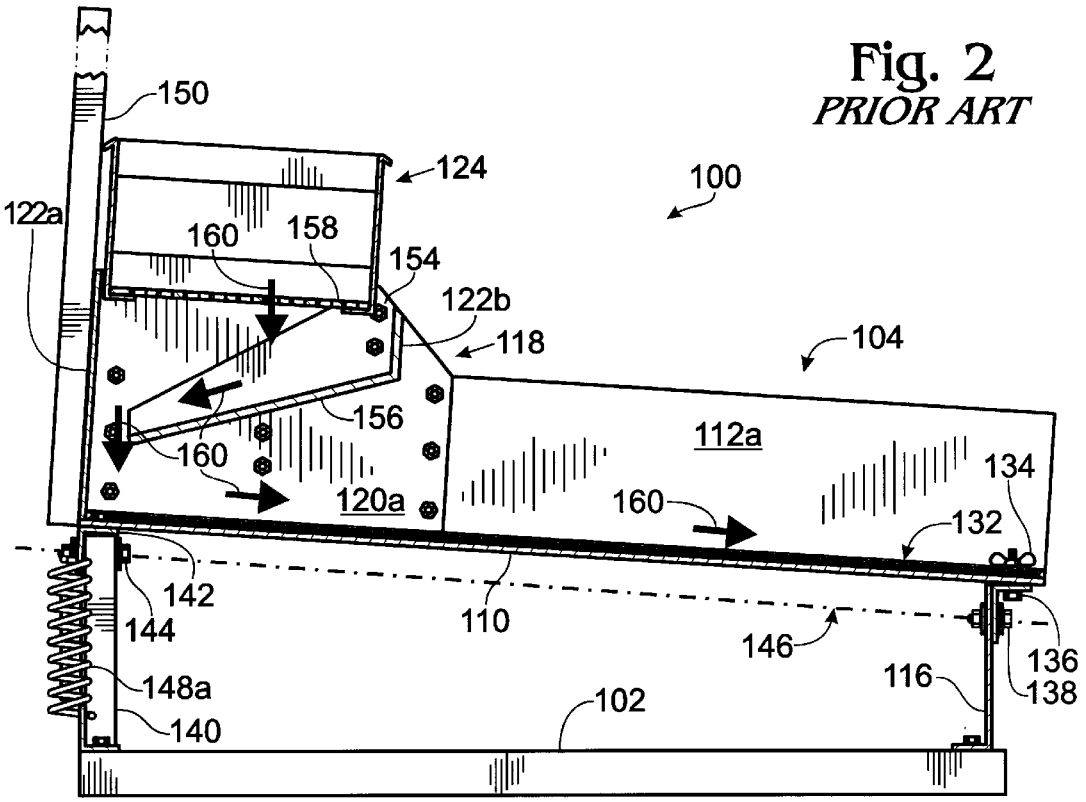
Fig. 2 PRIOR ART
FIG. 2 is a longitudinal cross-sectional view of the gold collector of FIG. 1.
Figure 3:
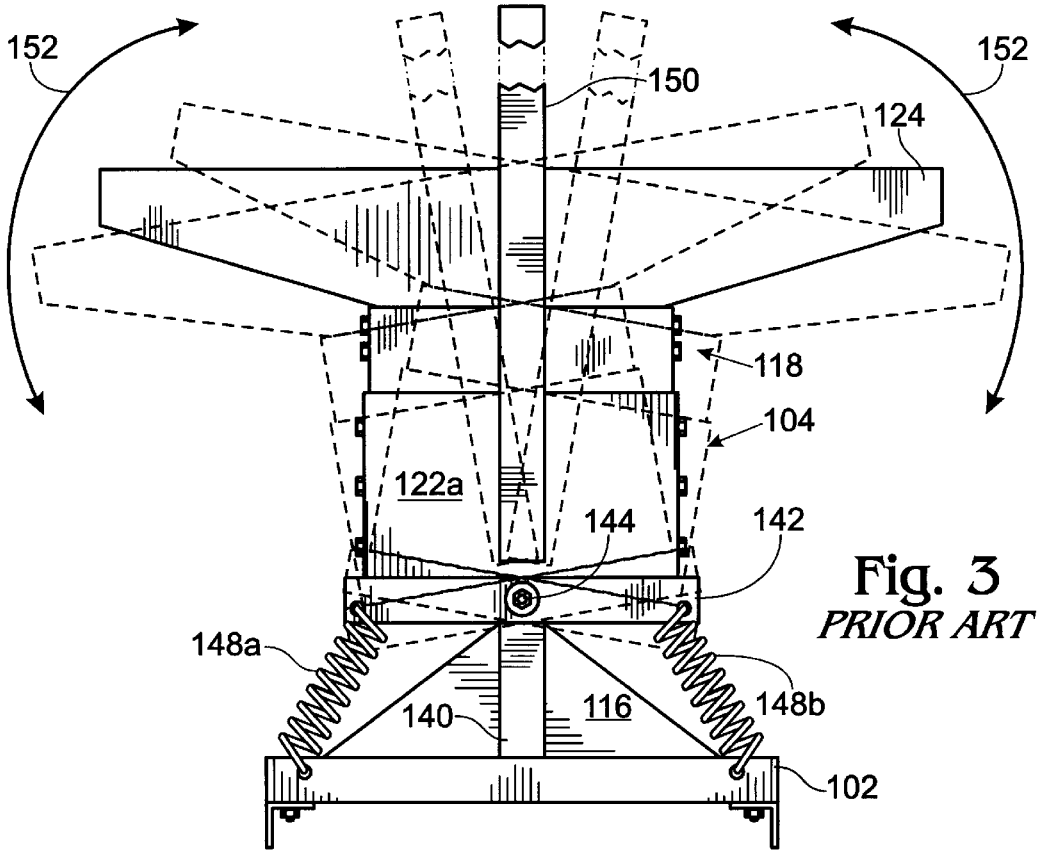
Fig. 3 PRIOR ART
FIG. 3 is an end elevation view of the gold collector of FIG. 1 showing the operation of its double spring-loaded rocking mechanism.
Figure 6:
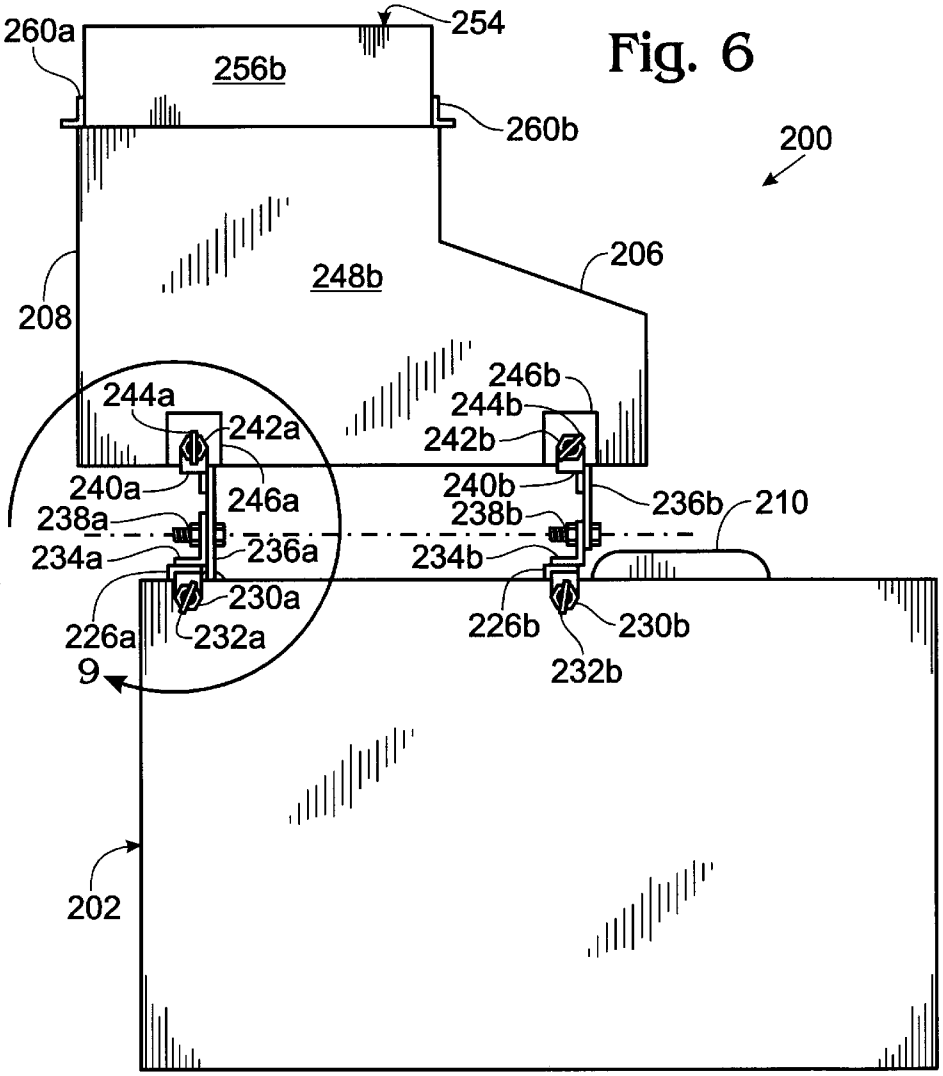
FIG. 6 is a side elevation view of the gold separation kit of FIG. 4.
Figure 5:
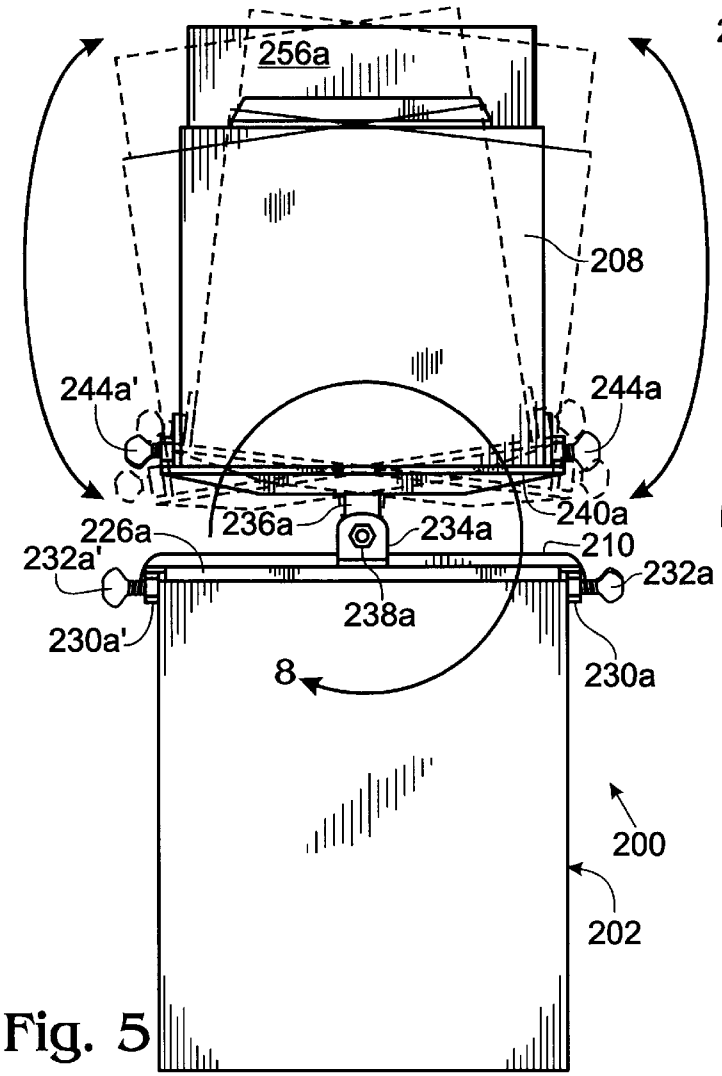
FIG. 5 is a rear end elevation view of the gold separation kit of FIG. 4.

Atop lower struts 226*a* and 226*b* and at the centers thereof are respectively attached first and second flat center posts 234*a*, 234*b*, formed essentially of L-shaped pieces with the long arm of the "L" pointing upwardly as best seen in FIG. 6. Contiguous to first center post 234*a* is an elongate bar 236*a*, and contiguous to second center post 234*b* is a short bar 236*b*, first center post 234*a* and elongate bar 236*a*, and similarly second center post 234*b* and short bar 236*b*, being respectively rotatably interconnected by means of first and second pivots 238*a*, 238*b*, which each essentially comprise a nut and bolt structure. Elongate bar 236*a* connects at the top thereof to the center of upper strut 240*a*, and short bar 236*b* connects at the top thereof to the center of upper strut 240*b*, both upper struts 240*a*, 240*b* being elongate flat and narrow plates similar to lower struts 226*a*, 226*b*. Upper nuts 242*a*, 242*a*', 242*b* and 242*b*' are respectively disposed at opposite ends of upper struts 240*a*, 240*b*, and a corresponding set of turn bolts 244*a*, 244*a*', 244*b* and 244*b*' are inserted therein whereby inward ends of turn bolts 244*a*, 244*a*', 244*b* and 244*b*' can be tightened against respective dimpled pads 246*a*, 246*a*', 246*b* and 246*b*' that are disposed along the lower sides of sluice box 206 (dimpled pads 246*a* and 246*b* are disposed along front side wall 248*b* of sluice box 206 and are visible in FIG. 1; dimpled pads 246*a*' and 246*b*' are disposed directly oppositely thereto on rear side wall 248*a* of sluice box 206 and are not visible in FIG. 1), thereby to hold sluice box 206 onto the top surfaces of upper struts 240*a*, 240*b* in a predetermined location. The dispositions of lower struts 226*a*, 226*b* and upper struts 240*a*, 240*b* are such as to place the rearward end of sluice box 206 somewhat outwardly from rearward end wall 224*a* of box 202 as can be seen in FIG. 6. First and second pivots 238*a*, 238*b* are coaxial, and the rotational connection of elongate bar 236*a* and short bar 236*b* at those pivots permits a transverse "rocking" motion of upper struts 240*a*, 240*b* relative to lower struts 226*a* and 226*b*, caused by manual rocking of sluice box 206. A rear elevation view of the principal components of gold separation kit 200 is shown in FIG. 5, wherein the rocking of sluice box 206 is shown by shadow drawings thereof on either side of the vertically straight solid drawing, as well as by the indicated arrows. A side elevation view of the same structure is shown in FIG. 6, and in both of FIGS. 5, 6 the numerals have the significance previously described.

Sluice box 206 further comprises a rectangular sluice plate 250, on opposite long sides of which rear and front side walls 248*a*, 248*b* as just mentioned extend upwardly. Mutually facing side walls 248*a*, 248*b* are roughly in the shape of a rather square "foot," the "toe" direction of which points frontwardly along box 202 when sluice box 206 is installed thereon as previously described. At the rear of the "foot" a nearly square back wall 252*a* extends upwardly from sluice plate 250 and also fully between side walls 248*a*, 248*b*, while a front wall 252*b* extends between side walls 248*a*, 248*b* only at the front of the "ankle" portion of the "foot," leaving the top of the "foot" open. The upper edges of side walls 248*a*, 248*b* and of back and front walls 252*a*, 252*b* are all coplanar and leave an opening therebetween, while the periphery of side walls 248*a*, 248*b* and of back and front walls 252*a*, 252*b* essentially defines the horizontal extent of material tower 208.

Figure 10:
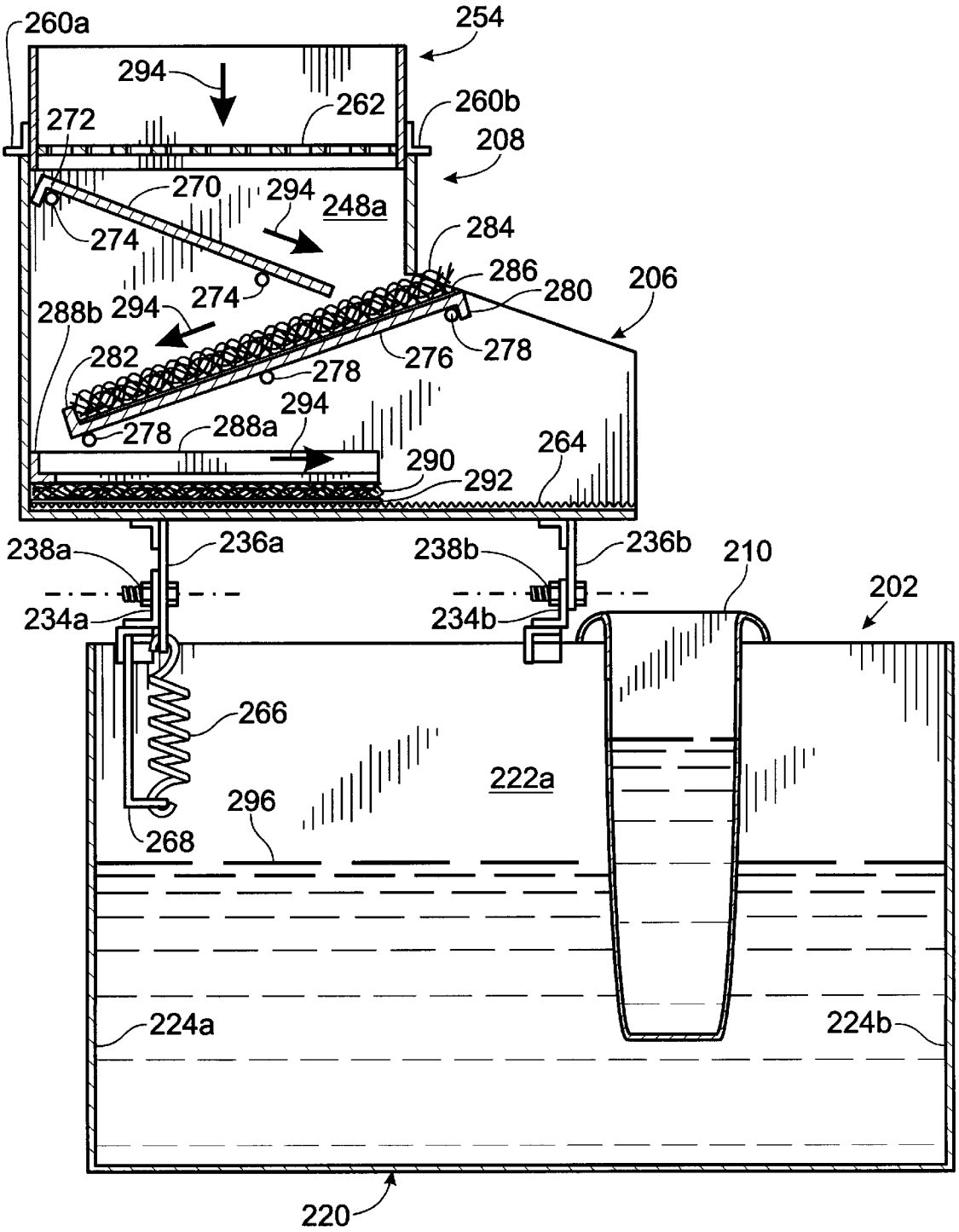
FIG. 10 is a cross-sectional view of the gold separation kit of FIG. 7 taken along the line 10–10'.

As also seen in FIGS. 4–6, and in the top plan view of FIG. 7, gold separation kit 200 further comprises classifier 254 consisting essentially of four rectangular and vertical walls 256*a*, . . . , 256*d* that are mutually joined at the bottom by a nearly square filter plate 258, as can best be seen in FIG. 7. Classifier 254 further comprises rear and front handles 260*a*, 260*b* near the top of walls 256*a*, 256*c* that serve to hold classifier 254 atop material tower 208 when placed thereon. The outer dimensions of classifier 254 are slightly less than the inside dimensions of material tower 208, so that classifier 254 can nestle inside the top of material tower 208 as shown in FIGS. 7 and 10 without danger of being dislodged therefrom when sluice box 206 and material tower 208 are transversely "rocked" as previously described. At the bottom of classifier 254 is a rectangular grill 262 that participates in breaking up larger pieces of material into smaller pieces that can pass therethrough.

FIG. 7 shows a top plan view of the major components of gold separation kit 200, i.e., box 202, sluice box 206, material tower 208, collector tray 210, classifier 254 with its handles 260*a*, 260*b*, and grill 262. In addition, corrugated mat 264 (seen also in FIGS. 4 and 10) is seen to cover the top surface of sluice plate 250 (that defines the bottom of sluice box 206) and serves to collect fine dust particles of gold as will be hereinafter described.

FIGS. 8, 8*a* show an enlarged and partially cutaway vertical elevation view of the mechanism by which a restoring force is brought to bear on sluice box 206 when it is transversely rotated as shown in FIG. 5. It has been customary, as in previously described gold collector 100 from the prior art, to use a spring connection to provide a restoring force for each of the two different directions of rotation, e.g., springs 148*a*, 148*b* for both clockwise and counterclockwise rotation. However, the present invention accomplishes that same purpose by the use of a single spring, which thus avoids the problem of a pair of springs eventually becoming unbalanced as was previously described. Specifically, FIG. 8, which is taken from region "8" of FIG. 5, shows a single spring 266 in addition to the elements already identified, i.e., box 202, sluice box 206, lower strut 226*a*, lower nuts 230*a*, 230*a*', lower turn bolts 232*a*, 232*a*', first center post 234*a*, elongate bar 236*a*, first pivot 238*a*, upper strut 240*a*, upper nuts 242*a*, 242*a*' and upper turn bolts 244*a*, 244*a*'. The higher end of spring 266 is connected near to the lower end of elongate bar 236*a*, while the lower end of spring 266 is connected at the lower end of another bar, i.e., spring bar 268, that connects at the top end thereof to lower strut 226*a* (this connection can be seen in FIG. 10). As now shown in FIG. 8A, wherein like elements have like numbers, rotation of sluice box 206 about first pivot 238*a* causes a like rotation of elongate bar 236*a*, the lower end of which is rotated away from its previous central position thereby causing a stretching of spring 266 that is attached at one end to that lower end of elongate bar 236*a* and at the opposite end to the lower end of spring bar 238. Spring bar 238 is fixedly attached to lower strut 226*a* and thereby provides the restoring force tending to return sluice box 206 to its central position. Put another way, elongate bar 236*a* attaches at opposite ends to sluice box 206 and to one end of spring 266, and is also rotatably attached therebetween to first pivot 238*a*, so that rotation of sluice box 206 requires a like rotation of the opposite end of elongate bar 236*a* which is attached to one end of spring 266 that provides a restoring force. Of course, a rotation in a direction opposite that shown in FIG. 8A would generate an opposite restoring force, again through the stretching of spring 266. Thus, a restoring force with respect to both senses of rotation is provided by the single spring 266. The relative dispositions of the components of FIGS. 8 and 8A can also be seen in FIG. 9, which is an enlarged and partially cutaway vertical side elevation view of region "9" in FIG. 6.

FIG. 10 is a longitudinal cross-sectional view of gold separation kit 200 (but not including carrying strap 204, water dipper 212, or gold pan 214 shown in FIG. 4) taken through the line 10–10' of FIG. 7, in connection with which the use of gold separation kit 200 may be most easily explained. In particular, material tower 208 further comprises a first tray 270 including downwardly extending first holding lip 272, all of which rests on first rivets 274 that extend from rear side wall 248*a* into the interior of material tower 208. A like set of first rivets (not shown) will of course extend into that interior from front side wall 248*b*. First tray 270 slants downwardly towards the front of material tower 208.

Second tray 276 similarly rests on second rivets 278 that likewise extend from rear side wall 248*a* into the interior of material tower 208, and a like set of second rivets (not shown) will extend into that interior from front side wall 248*b*. Second tray 276 further comprises downwardly extending second holding lip 280, which serves to hold second tray 276 onto second rivets 278, and upwardly extending retaining lip 282 at the opposite end of second tray 276 that serves to hold in place a rectangular piece of rather course, porous first matting 284, including a solid backing 286 on the bottom side thereof, as exemplified by the material sold by the 3M Company under the trade name "Nomad Carpeting." Second tray 276 is positioned generally under first tray 270 and slants downwardly towards the rear of material tower 208. First matting 284 serves to collect gold particles as will be described hereinafter.

Mounted onto rear side wall 248*a* and back wall 252*a* of material tower 208 and extending into the interior thereof are splash guards 288*a* and 288*b* as shown in FIG. 10, and a third such splash guard (not shown) is likewise mounted onto and extends inwardly from front side wall 248*b*. Splash guards 288*a*, 288*b* (and the third such splash guard not shown) serve to direct material falling from the bottom and perhaps from the sides of second tray 276 towards the central region at the bottom of material tower 208, and in particular onto second matting 290 that also has a solid backing 292 on the bottom thereof. Second matting 290 is preferably of a material such as "Nomad Carpeting" as is first matting 284, is of similar rectangular shape to first matting 284, and is positioned generally beneath second tray 276, i.e., in the rearward portion of sluice box 206 (atop corrugated mat 264) so as to catch material falling therefrom. The course to be followed by the material from which gold is to be extracted is shown in FIG. 10 as path 294, as will now be explained.

Operation of gold separation kit 200, once it has been transported by use of carrying strap 204 to a place at which gold is sought to be recovered, consists of first removing lid 216 and then collector tray 210, water dipper 212, and gold pan 214. All of the remaining components of gold separation kit 200 are then taken out and assembled as shown in the several drawings. Box 202 is then partially filled with water 296 as shown in FIG. 10, either by dipping box 202 itself into an available source of water, or else dipping water into box 202 using any one or more or all of collector tray 210, water dipper 212, and gold pan 214.

Material to be searched for gold can is then collected from a stream bed if adjacent a stream, or from bare outcroppings or other geological structures in which gold might be thought to be found, using any one or more or all of collector tray 210, water dipper 212, and gold pan 214, and such material is then deposited into the top of classifier 254. Both of collector tray 210 and water dipper 212 will now have their specialized uses.

Specifically, collector tray 210 is placed atop box 202 so as to be under the open end of sluice box 206 as shown in FIG. 10. Water dipper 212 is then used to dip water 296 out of box 202 and pour it into classifier 254. With stirring, and lateral rocking of sluice box 206 and material tower 208 as previously described, the material within classifier 254 will be washed downward along path 294, i.e., through grill 262 onto first tray 270; from the lower end of first tray 270 onto first matting 284; through the porous structure of first matting 284 and then off the lower end or sides thereof onto splash guards 288*a*, 288*b* (and also a third splash guard (not shown) that extends inwardly from front wall 248*b* of material tower 208) onto second matting 290; and thence further rightwardly in FIG. 10 down onto corrugated mat 264 and to the open end of sluice box 206 where that material falls into collector tray 210. That material, which is typically called "tailings," having then been screened of any loose gold, can be discarded.

If the deposit of tailings back into a stream is unimportant, gold separation kit 200 can be assembled such that sluice box 206 and material tower 208 are more forward over box 202 than is shown in FIG. 10, i.e., sufficiently forward such that the open end of sluice box 206 extends past the rightward end of box 202, whereby the tailings will drop onto the ground or back into the stream if gold separation kit 200 has been set up in a stream bed. Such an operation would be akin to that carried out using gold collector 100, but with the advantage that the tailings would drop further and thus be less inclined to build up under the device and need to be shoveled away.

Once a first sample of material has been so treated, each of first matting 284, second matting 290, and corrugated mat 264 are rinsed of gold residue by being turned upside down and inserted into gold pan 214 for washing with more water and then panning in the usual manner. Any gold contained in the pan is collected, and each of the preceding steps, commencing with collection of a new sample of material to be screened for gold, is repeated.

In addition to having a device that because of the weight of the water contained therein will neither tip over easily nor move about when being rocked, gold separation kit 200 offers other distinct advantages. In the first place, gold panning and the like are often quite restricted by game and fish authorities in terms of the times and places at which they can be carried out, for the reason that many of the prior art devices used for that purpose must be used immediately adjacent a stream bed, thus causing muddying of the water which is detrimental to fish. Gold separation kit 200 presents little or no likelihood of muddying stream water, inasmuch as the only contact with the stream required consists firstly of dipping out material to be screened for gold, which can be carefully done so as to minimize stream disturbance.

Secondly, the water that is to be used for washing out gold can be collected from any source, or indeed carried in to the site, and hence need not be taken from the same stream that one wishes to examine for gold. Indeed, since gold separation kit 200 is self-contained, needing only material to be screened and water for washing out any gold, it can be used essentially anywhere, i.e. far from any stream.

Also, gold separation kit 200 is entirely manually (and indeed quite easily) operated, with no need for external power sources, water pumps, generators and other energy consuming devices that may also present a fire danger, as may be found as parts of some prior art gold prospecting equipment.

It will be understood by those of ordinary skill in the art that other arrangements and disposition of the aforesaid components, the descriptions of which are intended to be illustrative only and not limiting, may be made without departing from the spirit and scope of the invention, which must be identified and determined only from the following claims and equivalents thereof.

I claim:

1. A gold separation kit comprising:

a carrying box having an open top area, a removably attachable lid sized to enclose said open top area, and an elongate, flexible carrying strap removably attachable at opposite ends thereof to said carrying box, said carrying strap being sized between said opposite ends fit the shoulder of a person, whereby when said carrying strap is attached to said carrying box, said carrying strap may be hung over the shoulder of a person as a means for carrying said carrying box;

a sluice box removably disposable within said carrying box;

a material tower removably disposable within said carrying box;

a classifier for breaking up material that has been placed into said material tower, removably disposable at a downward location within said material tower and having an outlet;

means for rotatably mounting said sluice box, material tower and classifier above said carrying box; and a collector tray sized to fit within said carrying box at a location below said outlet of said classifier.

2. The gold separation kit of claim 1 wherein said material tower comprises: one or more trays disposed beneath said classifier in a vertical sequence for acceptance therein of material.

3. The gold separation kit of claim 2 wherein said one or more trays further comprise matting disposed on upper surfaces thereof to receive said material and screen particles of gold therefrom.

4. The gold separation kit of claim 1 wherein said sluice box further comprises a corrugated mat disposed on an upper surface thereof.

5. The gold separation kit of claim 4 wherein said material tower comprises: one or more trays disposed beneath said classifier in a vertical sequence for acceptance therein of material.

6. The gold separation kit of claim 5 wherein said one or more trays further comprise matting disposed on upper surfaces thereof to receive said material and screen particles of gold therefrom.

7. The gold separation kit of claim 1 further comprising a water dipper removably disposable within said carrying box.

8. The gold separation kit of claim 1 further comprising a gold pan removably disposable within said carrying box.

* * * * *